US006447374B1

(12) United States Patent
Sommer et al.

(10) Patent No.: US 6,447,374 B1
(45) Date of Patent: Sep. 10, 2002

(54) CHEMICAL MECHANICAL PLANARIZATION SYSTEM

(75) Inventors: Phillip R. Sommer, Newark, CA (US); Paul B. Butterfield, San Jose, CA (US); Manoocher Birang, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/651,659

(22) Filed: Aug. 29, 2000

Related U.S. Application Data

(60) Provisional application No. 60/172,416, filed on Dec. 17, 1999.

(51) Int. Cl.[7] ..... B24B 1/00

(52) U.S. Cl. ..... 451/56; 451/41; 451/443; 451/444

(58) Field of Search ..... 451/41, 51, 56, 451/72, 168, 285, 287, 304, 305, 306, 443, 444

(56) References Cited

U.S. PATENT DOCUMENTS

| | | | | |
|---|---|---|---|---|
| 5,569,062 A | | 10/1996 | Karlsrud | 451/285 |
| 5,842,912 A | | 12/1998 | Holzapfel, et al. | 451/72 |
| 5,857,899 A | | 1/1999 | Volodarsky et al. | 451/72 |
| 5,906,754 A | | 5/1999 | Appel et al. | 216/88 |
| 5,941,762 A | * | 8/1999 | Ravkin et al. | 451/56 |
| 6,004,196 A | * | 12/1999 | Doan et al. | 451/443 |
| 6,019,670 A | | 2/2000 | Cheng et al. | 451/56 |
| 6,123,607 A | * | 9/2000 | Ravkin et al. | 451/56 |
| 6,196,899 B1 | * | 3/2001 | Chopra et al. | 451/56 |
| 6,276,996 B1 | * | 8/2001 | Chopra | 451/41 |

FOREIGN PATENT DOCUMENTS

| | | | |
|---|---|---|---|
| WO | WO 98/45090 | 10/1998 | B24B/53/10 |

* cited by examiner

*Primary Examiner*—Joseph J. Hail, III
*Assistant Examiner*—David B. Thomas
(74) *Attorney, Agent, or Firm*—Moser, Patterson & Sheridan

(57) ABSTRACT

A semiconductor wafer processing system, more specifically, a chemical mechanical planarization system including a polishing media reconditioning system. In one embodiment, the polishing media reconditioning system comprises at least a first and second conditioning roller that contact a working surface of a polishing media while rotating in opposite directions. Other embodiments include conditioning plates disposed on a carrier that includes the polishing head, a conditioning roller or disk that traverses the surface of the polishing media and a conditioning disk that conditions the polishing media while retained in the polishing head. Alternatively, the polishing media may be conditioned utilizing the devices embodied above remotely from the processing system.

34 Claims, 12 Drawing Sheets

CHEMICAL MECHANICAL PLANARIZATION SYSTEM

This application claims benefit of U.S. Provisional Application No. 60/172,416, filed Dec. 17, 1999, which is hereby incorporated by reference in its entirety.

BACKGROUND OF THE DISCLOSURE

1. Field of Invention

The present invention relates generally to a chemical mechanical planarization system. More specifically, the invention relates to a method and apparatus for conditioning polishing pads of a chemical mechanical planarization system.

2. Background of Invention

In semiconductor wafer processing, the use of chemical mechanical planarization, or CMP, has gained favor due to the enhanced ability to deposit multiple layers on a substrate for electronic devices. As the demand for planarization of wafers in semiconductor fabrication increases, the requirement for greater system (i.e., tool) throughput with less wafer damage and enhanced wafer planarization has also increased.

Two such CMP systems that address these issues are described in a patent to Perlov et al. (U.S. Pat. No. 5,804,507, issued Sep. 8, 1998) and in a patent to Tolles et al. (U.S. Pat. No. 5,738,574, issued Apr. 15, 1998), both of which are hereby incorporated by reference. Perlov et al. and Tolles et al. disclose a CMP system having a planarization apparatus that is supplied wafers from cassettes located in an adjacent liquid filled bath. A transfer mechanism, or robot, facilitates the transfer of the wafers from the bath to a transfer station. From the transfer station, the wafers are loaded to a processing head. A carousel delivers the processing head and wafer to various planarization stations where the wafers are planarized by moving the wafer relative to a polishing pad in the presence of a slurry. The polishing pad may include an abrasive surface. Additionally, the slurry may contain both chemicals and abrasives that aid in the removal of material from the wafer. After completion of the planarization process, the wafer is returned back through the transfer station to the proper cassette located in the bath.

Another system is disclosed in a patent to Hoshizaki et al. (U.S. Pat. No. 5,908,530, issued Jun. 1, 1999) which is hereby incorporated by reference. Hoshizaki et al. teaches an apparatus for planarizing wafers wherein the wafer is subjected to uniform velocity across the wafer surface with respect to the abrasive surface. The uniform velocity across the wafer surface coupled with a multi-programable planarization pattern results in a uniform rate of material removal from the wafer surface. In addition, Hoshizaki et al. provides a number of optional routines that allow a user to fine tune material removal from the wafer.

The systems described above can generally utilize polishing pads with and without abrasive finishes. The polishing pads may be stationary or move relative to the wafer. Additionally, abrasive slurry, de-ionized water and other fluids may be disposed on the polishing pad during the processing of the wafer.

Common to these and other planarization systems, is the need to periodically condition the pad or polishing media. During the planarization process, the polishing media may become worn from contact with the wafer and polishing slurry. Fixed abrasives often used in polishing media may also have the abrasive particles dislodged during processing.

Additionally, material removed from the wafer may become impacted or clog the surface topography of the polishing media. Worn, damaged and clogged polishing pads may cause inconsistent material removal from the wafer that can result in less than desirable planarization and may cause other surface defects (i.e., scratching) that may render the wafer defective.

An approach typically used to condition the polishing media (i.e., creating or returning the polishing media to an optimized state for wafer processing) is to dress the polishing media. Dressing typically includes moving a biased brush, or a single patterned plate against the polishing media, spraying fluids against the polishing media, applying mega or ultra sonic energy to the polishing media or "vacuuming" the surface of the polishing media. Often, this process occurs at the working region by scanning the dressing device across the polishing pad in a pattern similar to the planarization pattern. These dressing processes (interchangeably referred to as conditioning processes) are periodically employed to return the polishing media to a state that produces acceptable planarization without damaging the wafer. Generally, either a conditioning device is set in the polishing head or the polishing media is conditioned periodically between wafer processing runs. Disadvantageously, both of these methods result in diminished wafer throughput since the processing of wafers is halted while a working region of the polishing media is conditioned.

A device that provides an improvement over the typical conditioning process is a "Polishing Media Magazine" coupled to a planarization system disclosed in the commonly assigned U.S. patent application to Sommer (U.S. patent application Ser. NO. 08/961,602, filed Oct. 31, 1997 and hereinafter referred as "Sommer '602"). The Sommer '602 patent application is hereby incorporated by reference.

Sommer '602 discloses a polishing media in the form of a web. The web passes from a supply roll through the working region of the processing system to a take-up roll. A conditioning system is disposed between the supply and take-up roll. The conditioning system is positioned outside a working region so that the entire width of the polishing media can be conditioned as the web advances. Conditioning the entire width of the polishing media in one pass results in better utilization of tool time and a corresponding increase in wafer throughput as compared to traditional pad conditioning processes such as scanning the work surface with the dressing device. However, faster conditioning and more versatile conditioning of the polishing media is desirable to increase wafer throughput, minimize wafer damage and enhance wafer planarization.

Therefore, there is a need for a method and apparatus for conditioning polishing pads.

SUMMARY OF INVENTION

One aspect of the present invention generally provides an apparatus for conditioning a polishing surface. In one embodiment, the apparatus comprising polishing head having a ring disposed on a perimeter of the ring, the ring having a conditioning surface is provided. Another embodiment of the invention provides polishing media, a first conditioning and a second conditioning device that are actuated to contact the polishing media with opposing rotational velocities.

In another embodiment of the invention, a free standing conditioning system for conditioning the surface of a web is provided. In one embodiment, a conditioning system includes an unwind, a conditioning module and a winder.

The conditioning module comprises one or more of the conditioning devices selected from the group of devices including at least a first and a second conditioning plate selectively contacting a working surface of the polishing media while rotating in opposite directions, one or more brushes, one or more water jets, one or more wave energy devices and one or more vacuum devices.

In another embodiment of the invention, a polishing table, a web of polishing media having at least a portion disposed on the polishing table, and a conditioning device selectively disposed to contact the polishing media is provided. Additional embodiments of the conditioning device further include retaining rings, rods, disks and cylinders. Optionally, the conditioning devices may be moved or rotated.

In another aspect of the invention, a method for processing a substrate in a polishing system is provided. In one embodiment, a method includes processing a substrate on a portion of media; and conditioning another portion of the media. In another embodiment, a method includes advancing a web of polishing material and conditioning the polishing material.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical plate that are common to the figures.

DETAIL DESCRIPTION OF INVENTION

Figure 1:
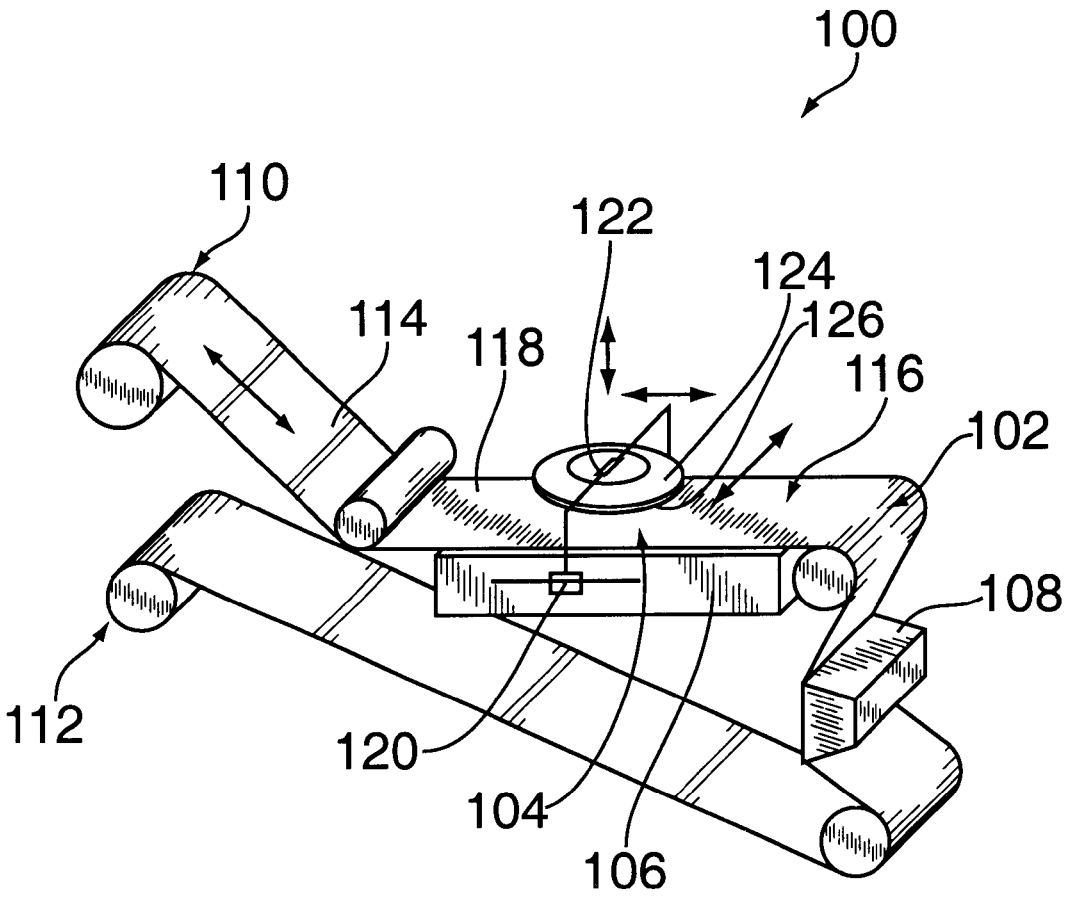
FIG. 1 is a simplified perspective view of a chemical mechanical planarization system having a conditioning module.

FIG. 1 depicts a schematic view of a chemical mechanical planarization system 100 including a conditioning module 108. The system 100 generally comprises a polishing media magazine 102, a linear drive system 104 and a base 106.

The polishing media magazine 102 generally comprises an unwind 110 and a winder 112. A web 114 of polishing media is run between the unwind 110 and the winder 112. The web 114 can be substantially "rolled-up" at either the unwind 110 or the winder 112, or partially wound on both the unwind 110 and the winder 112 such that various portions of the web 114 may be selectively exposed between the unwind 110 and the winder 112.

A working region 116 of the web 114 is disposed on the base 106 of the system 100. The working region 116 of the web 114 is orientated in relation to the base 106 such that a working surface 118 of the web 114 is on the side of the web 114 facing away from the base 106. An example of such a polishing media magazine 102 is described by Sommer in the U.S. patent application Ser. No. 08/833,278 (filed Apr. 4, 1997 and hereinafter referred as "Sommer '278"). The Sommer '278 patent application is hereby incorporated by reference.

The linear drive system 104 is coupled to the base 106. The linear drive system 104 typically comprises a first linear motion device 120, a second linear motion device 122 and one or more polishing heads 124. The polishing head 124 is movably positioned above the working region 116 of the web 114. The first linear motion device 120 and the second linear motion device 122 (which could be replaced by one device providing at least an equivalent range of motion) couples the polishing head 124 to the base 106. The linear motion devices 120 and 122 move the polishing head 124 in a programmable pattern in relation to the base 106.

The processing head 112 is lowered to contact the working surface 118 of the web 114. A wafer 126 disposed in the polishing head 124 is set in motion relative to the working surface 118. An abrasive slurry (not shown) can be disposed between the wafer 126 and the working surface 118 to facilitate material removal from a feature side of the wafer 126 in contact with the web 114. Other fluids, such as de-ionized water also may be disposed on the working surface. Optionally, the working surface 118 may comprise an abrasive coating, finish, covering and/or texture. An example of such a linear drive system 104 is described in the previously incorporated patent application Sommer '602.

The drive system 104, as described by Sommer '602, has a processing head which supports (i.e., holds a wafer) and is articulated in an x/y-plane. The processing head is movable along a z-axis to create contact with a stationary working surface 118. As the processing head is moved about the x/y-plane, the wafer is traversed about the working surface 118 in a planarization pattern. Additionally, a web covering the working surface is movably fixed upon the drive system such that the web may be advanced to cause a different section of the web to be positioned atop the working surface in contact with the wafer.

The exemplary system 100 of FIG. 1 depicts a web 114 of polishing media wherein the polishing head 124 is moved in reference to the base 106. However, the invention described herein is equally applicable to other drive systems including those in which the wafer is moved rotationally over a fixed polishing media (i.e., a polishing pad) and those in which the polishing media is moved under a fixed wafer.

Examples of such planarization systems are described in Hoshizaki et al. (U.S. Pat. No. 5,908,530, issued Jun. 1, 1999) and Sheldon (U.S. Pat. 5,899,800, issued May 4, 1999), both of which are hereby incorporated by reference.

The drive system described by Hoshizaki et al. holds the wafer stationary in a x/y-plane (i.e., the plane of the working surface) while moving the wafer against the working surface along a z-axis. The working surface is actuated in the x/y plane creating a planarization pattern relative the wafer.

The drive system described by Sheldon holds the wafer in a polishing head coupled to a carousel atop the base. The carousel moves the polishing head to a polishing station having a polishing media disposed thereon. The polishing head rotates while moving circularly in a x/y-plane (i.e., the plane of the working surface 118 of the polishing media). The wafer is held against the working surface along a z-axis of the polishing head. The rotation about the z-axis coupled with the circular movement about the x/y plane creates an orbital planarization pattern between the wafer and the polishing media.

The conditioning module 108 is generally disposed adjacent the working surface 118 of the web 114. The conditioning module conditions (i.e., dresses) the working surface 118 of the web 114 to create a uniformly textured working surface 118 that removes material from the surface of the wafer 126 at a uniform rate. In one embodiment, the conditioning module 108 is disposed adjacent the web 114 between the base 106 and the winder 112.

Figure 2:
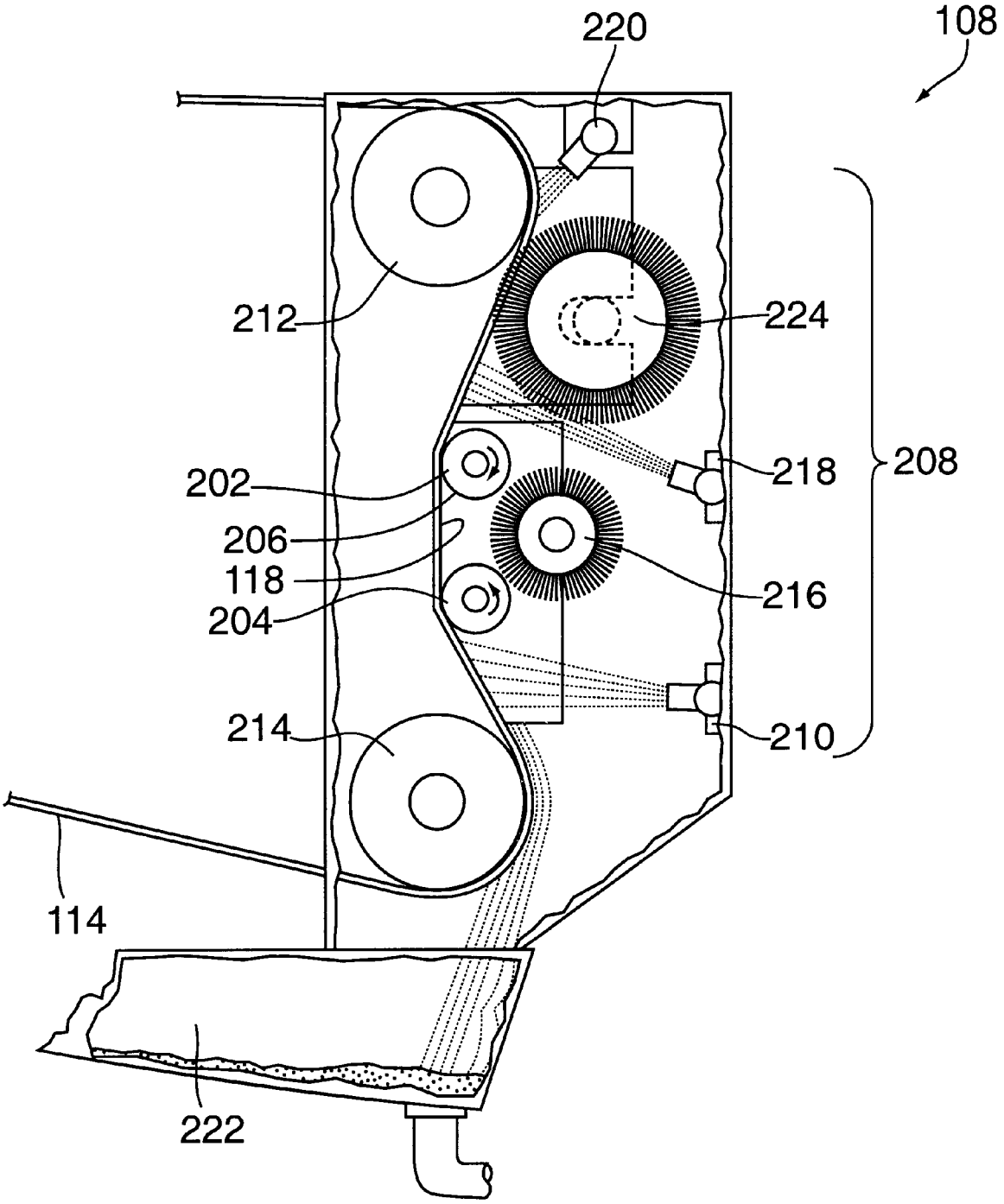
FIG. 2 is a schematic view of the conditioning module of FIG. 1.

Referring to FIG. 2, the conditioning module 108 comprises a first roller 202 and a second roller 204. Both the first and the second roller 204 may be selectively disposed against the web 114. Optionally, the force exerted by either the first roller 202 or the second roller 204 against the web 114 may be controlled. Generally, the rotational direction and the rotational velocity of each roller (202 and 204) is independently controlled by a motor (not shown). Examples of such motors are stepper motors, servo motors, air drives, and other devices for creating rotational motion. Such motors may be coupled directly to the roller, housed within the roller or remotely coupled to the roller. Alternatively, one roller (or single motor operatively coupled to the one roller) may optionally drive the both rollers. In one embodiment, the rotation of the first roller 202 is opposite the second roller 204.

The first roller 202 comprises a dressing surface 206. The dressing surface 206 generally spans the entire length of the roller but may alternatively be limited to contact only that portion of the web 114 that is used processing. The dressing surface 206 is typically treated or textured to provide the desired conditioning or dressing effects on the web 114. Generally, the dressing surface 206 is selected to provide a desired result during planarization. The dressing surface 206 is typically textured with an abrasive, such as a diamond coating, oxide, ceramic, copper, silicon carbide, resist or plastic. Alternatively, the dressing surface 206 may be machined, etched, or otherwise worked to provide a textured surface. With such textured surfaces it may be desirable to harden or process the surface to extend the service life of the roller. Examples of such hardening or other surface processes include induction heating, carbonizing, nitriding, ionnitriding, or by the application of surface coatings such as quartz, aluminum oxide, silicon carbide, cubic boron nitride, or other protective coatings. The second roller 204 is similarly composed.

Figure 12:
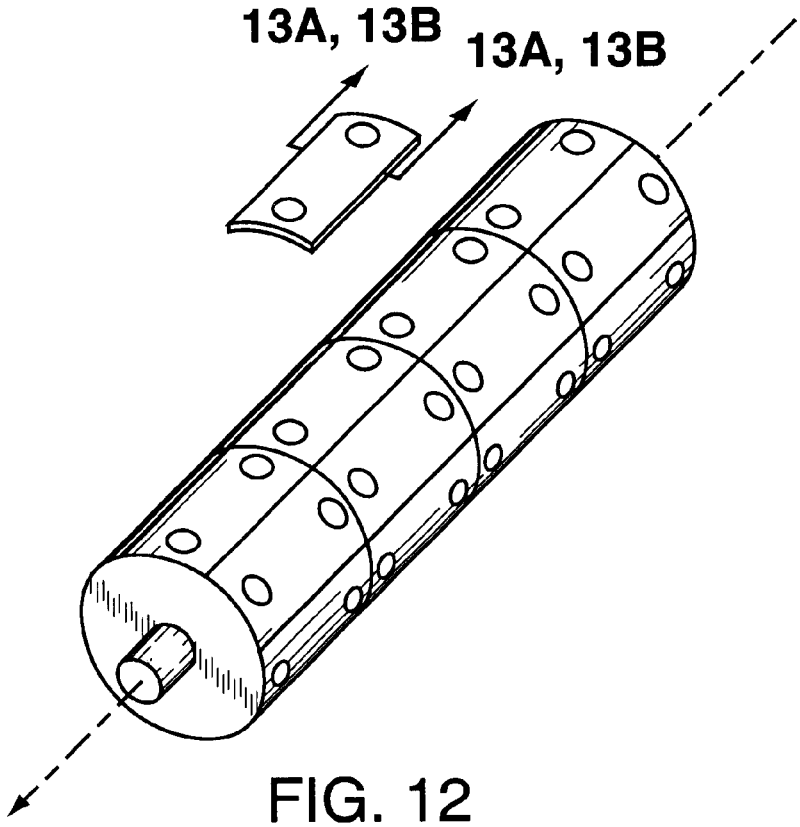
FIG. 12 is a perspective view of a conditioning roller.
Figure 13A:
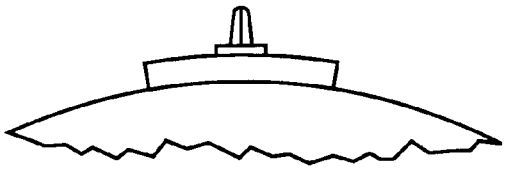
FIG. 13A is a sectional view of a conditioning plate of the conditioning roller of FIG. 12 taken along section line 13A—13A.
Figure 13B:
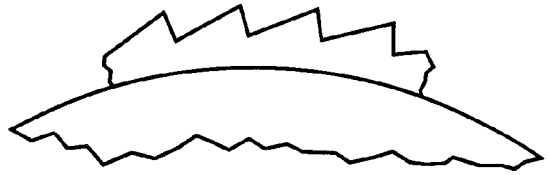
FIG. 13B is a sectional view of a conditioning plate of the conditioning roller of FIG. 12 taken along section line 13B—13B.

Referring to FIGS. 12, 13A and 13B, the dressing surface 206 of the roller 202 may alternatively comprise discrete, removal plates 1202 for ease of manufacture. The removable plates 1202 may be individually replaced when damaged or worn. The removable plates 1202 may comprise a textured surface as described above, or comprise other geometries such as one or more protruding points 1302 or series of ridges 1304.

The conditioning module 108 may optionally include additional devices 208 to augment the conditioning of the web 114. The one or more additional conditioning devices 208 may be individually added to the conditioning module 108 or added in any combination or variation in device quantity. Such additional conditioning devices 208 may include one or more brushes, fluid jets, megasonic wave generators and other conditioning devices. The position of these additional devices can be selectively chosen to impart a desired conditioning effect upon the web 114.

In the embodiment illustrated in FIG. 2, a first fluid jet 210 directs a fluid (typically de-ionized water) against the web 114 tensioned between a first idler 212 and a second idler 214 at a position adjacent to the second idler 214. One or both of the idlers (212 and 214) may be either driven by a motor (not shown), operatively coupled to a remote motor or other roller/idler, free cylinder, or operatively coupled to a brake (not shown). The fluid serves both to remove particulates and keep the web 114 moist. The first fluid jet 210 directs the fluid against the web 114 in a manner that prevents the fluid from wetting the non-working side of the web 114.

A first brush 216 is positioned to contact the dressing surfaces 206 of the first and second rollers (202 and 204). The first brush 216 removes material which may be on or impacting into the dressing surface 206.

A megasonic generator 218 is positioned between the first roller 202 and the first idler 212. The megasonic generator 218 imparts wave energy against the web 114, loosening debris that may be present on the web 114.

A second jet 220 is positioned to direct a cleaning fluid against the web 114 near the first idler 212. The second jet 220 operates similarly to the first jet 210.

A second brush 224 is positioned to contact the web 114 adjacent the first idler 212. The second brush 224 typically rotates in a direction that prevents debris from being transported by the web 114 (or swept by the second brush 224) onto the working region of the web 114. Optionally, a waste collector 222 is positioned to catch debris and fluids within the conditioning module 108.

In operation, the web 114 is advanced (in one direction, or sequentially in back and forth) past the first roller 202 and the second roller 204. The rollers (202 and 204) are actuated to contact the web 114. The rollers (202 and 204) are driven, in the same or opposing directions, producing a conditioning effect upon the web 114 (i.e., a surface condition is imparted upon the web 114 that contributes to producing a desired planarization process to the wafer 126). In one embodiment, the rollers (202 and 204) are maintained at a constant velocity and impart a uniform conditioning effect along a length of the web 114. The entire web 114 may be conditioned prior to processing. Additionally, selected sections of the web 114 may be conditioned during or between processing wafers 126. Using the first and second rollers (202 and 204) decreases the time required to condition the web 114. Additionally, since the rollers (202 and 204) may contain different conditioning surfaces 206, the range of conditioning effects that may be effected upon the web 114 can be expanded.

Figure 3:
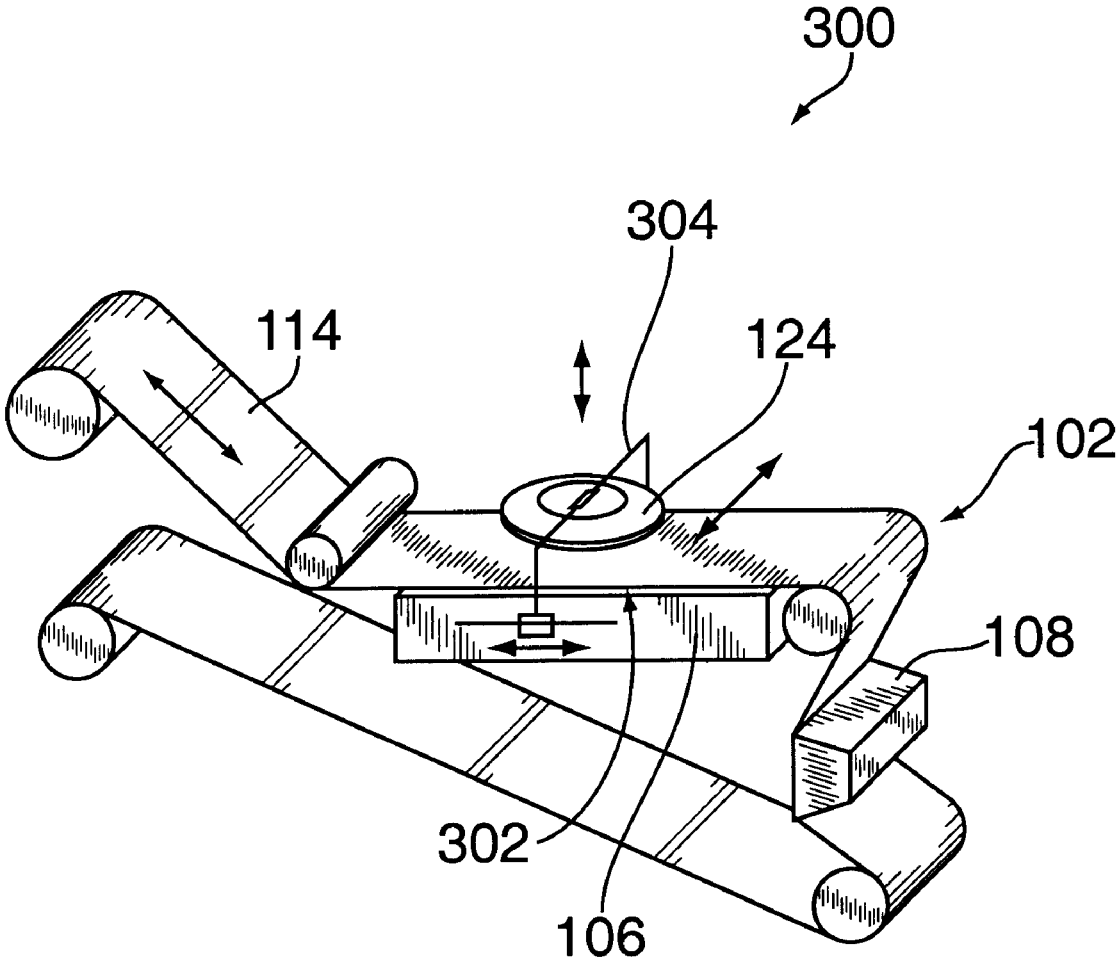
FIG. 3 is a simplified perspective view of another embodiment of a chemical mechanical planarization system having a carrier including one or more conditioning devices.

FIG. 3 depicts a schematic view of another embodiment of a chemical mechanical planarization system 300. The system 300 comprises a polishing media magazine 102, a linear drive system 302, a base 106 and an optional conditioning module 108. The polishing media magazine 102 is structured and operates as described in the embodiment of FIG. 1. The linear drive system 302 is generally similar to the linear drive system 102 of FIG. 1 with the addition of one or more conditioning devices disposed in a carrier 304 that supports one or more polishing heads 124.

Figure 4A:
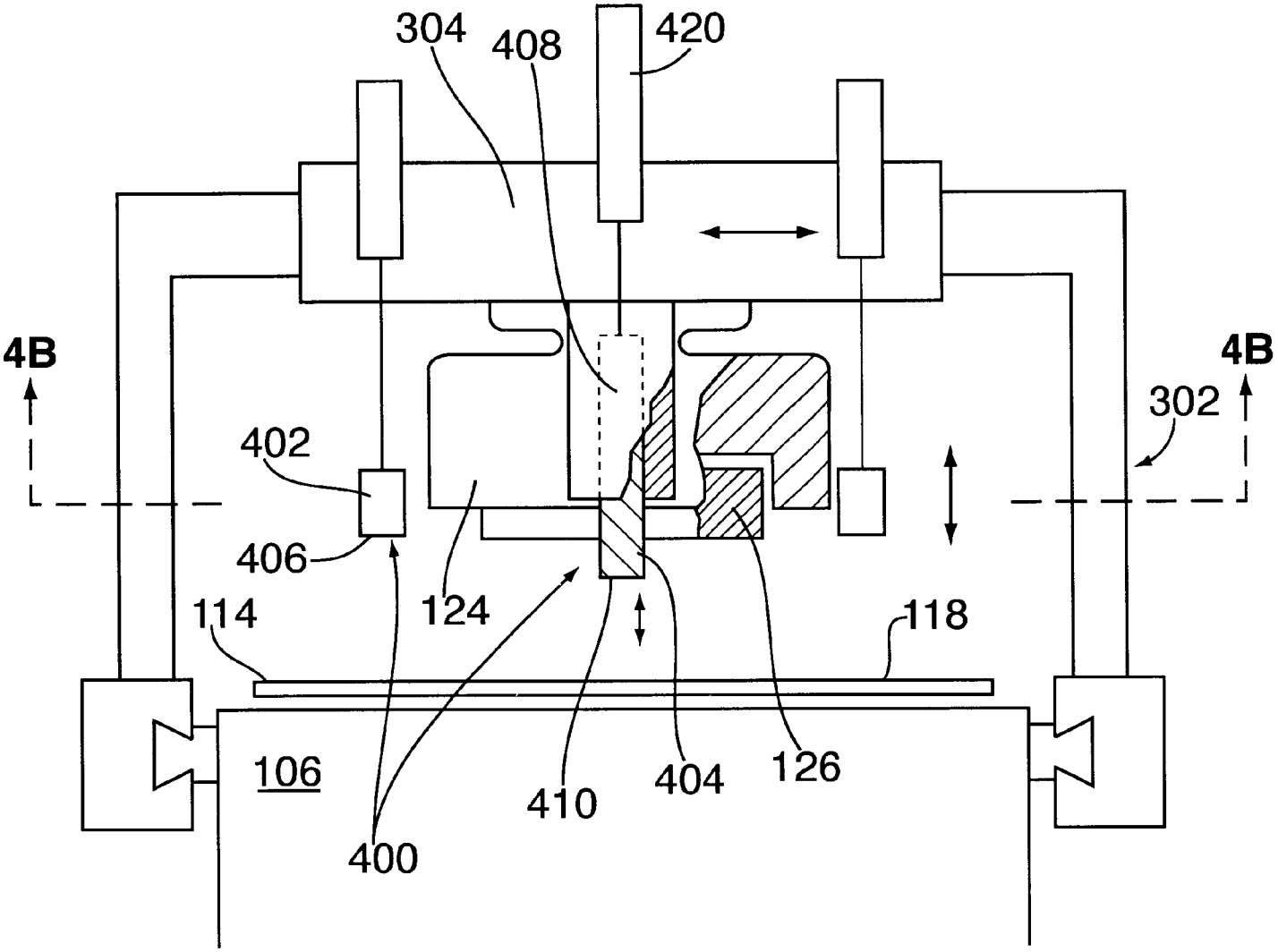
FIG. 4A is a partial cross sectional view of a carrier of FIG. 3.
Figure 4B:
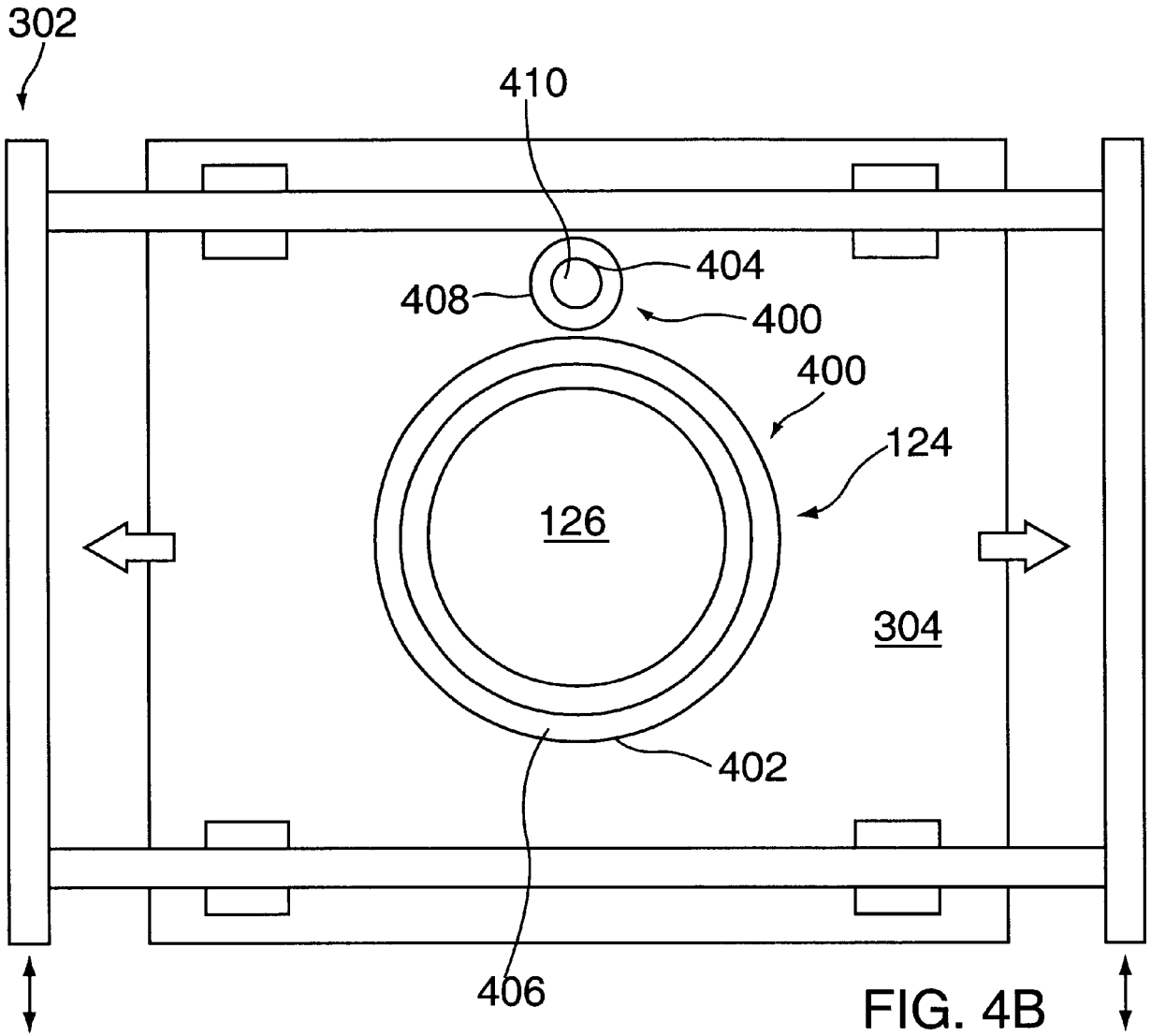
FIG. 4B is bottom view of the carrier of FIG. 4A.

Referring to FIGS. 4A and 4B, the conditioning devices 400 are movably coupled to the carrier 304. Alternatively, the conditioning devices may be coupled to the polishing heads 124 or other structure that moves in a "polishing pattern" relative to the web 114. The conditioning devices 400 are positionable with respect to both the polishing head 124 and a working surface 118 of a web 114. The conditioning devices 400 may comprise either a conditioning ring 402 and/or a conditioning rod 404. The conditioning ring 402 is disposed about the perimeter of the polishing head 124. The conditioning ring 402 may additionally serve as a retaining ring to keep the wafer 126 under the polishing head 124 while polishing. The conditioning ring 402 has a dressing surface 406. The dressing surface 406 is typically textured with an abrasive, such as a diamond coating, an oxide or a ceramic. The dressing surface 406 may be position as to selectively contact the web 114 when a wafer 126 is present in the polishing head 124, or may remain clear of the web 114 during wafer processing. The dressing surface 406 may alternatively be contacted against the web 114 when no wafers 126 are present in the polishing head 124.

Figure 6:
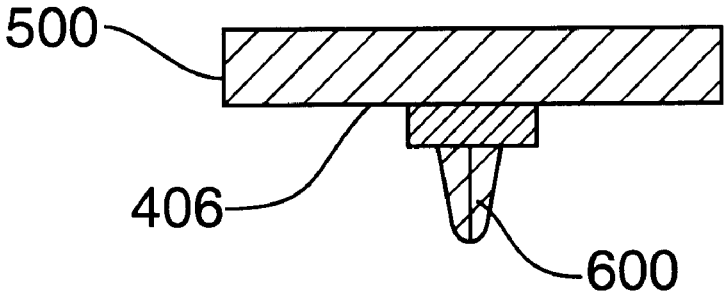
FIG. 6 is a cross sectional view of a conditioning plate taken along section line 6—6 of FIG. 5.
Figure 5:
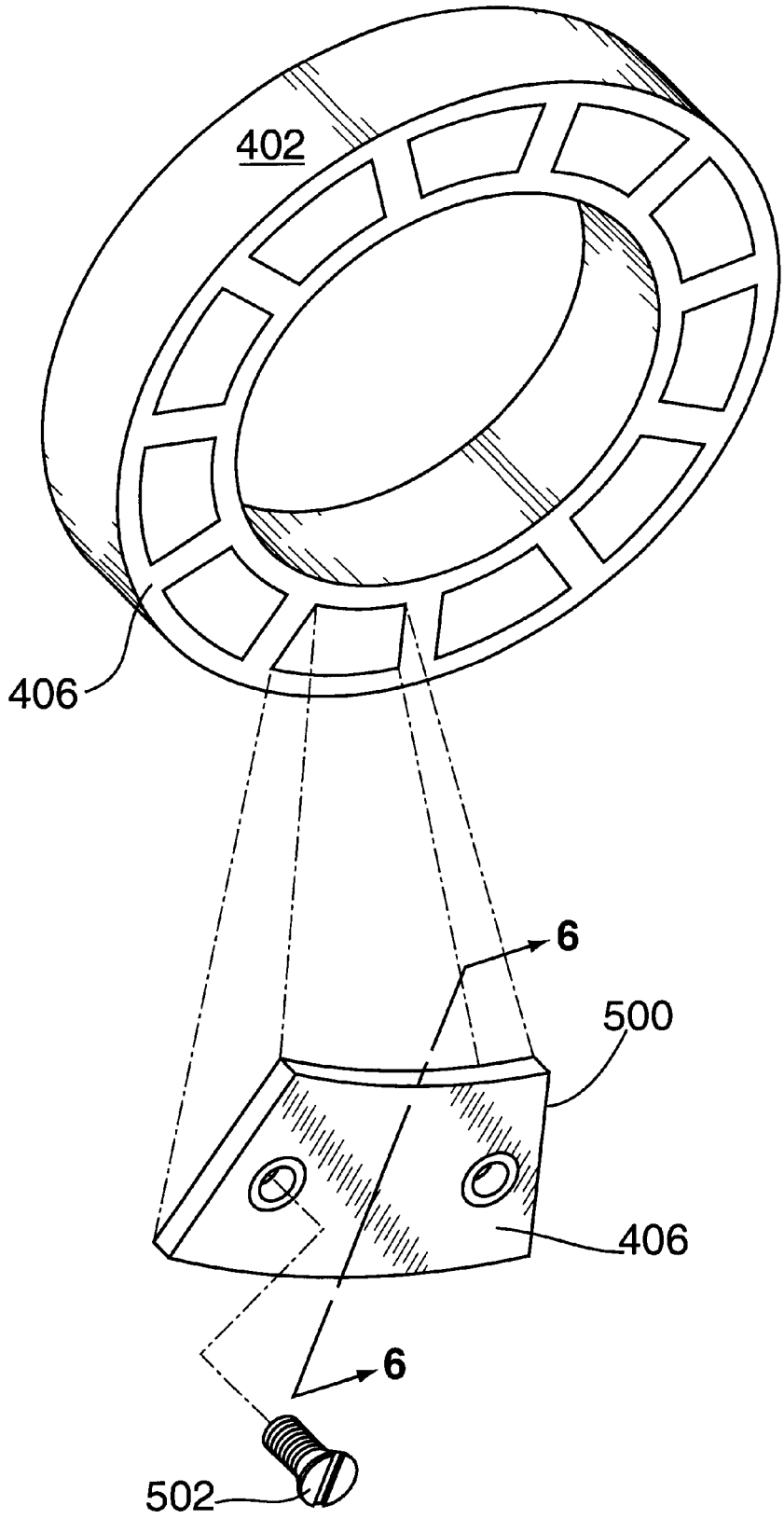
FIG. 5 a perspective view of one of the conditioning devices of FIG. 4A.

As depicted in FIGS. 5 and 6, the conditioning ring 402 may optionally be machined, etched, or otherwise worked to provide the texture to the dressing surface 406. The dressing surface 406 of the conditioning ring 402 may alternatively comprise discrete, removal plates 500 for ease of manufacture. The removable plates 500 may be individually replaced when damaged or worn. The removable plates 500 may be attached to the conditioning ring 402 in any fashion that permits removal of the plate 500 while substantially holding the plate 500 to the conditioning ring 402 during wafer processing. In one embodiment, the plate 500 is fastened to the conditioning ring 402 using a screw 502 (such as a flat head machine screw) having a head that is disposed below the dressing surface 406. The removable plates 500 may comprise a textured surface as described above, or comprise other topographies such as one or more protruding points 600.

Returning to FIGS. 4A and 4B, the conditioning rod 404 is generally a cylinder or other shape that is operatively coupled to the carrier 304 by a sleeve 408. The sleeve 408 is generally positioned outward of the conditioning ring 402. Alternatively, the conditioning rod 404 may be coupled to other portions of the carrier 304. The conditioning rod 404 is coupled to an actuator 420 that moves the conditioning rod 404 in contact with the polishing media. The sleeve 408 retains a textured surface 410 of the conditioning rod 404 in a substantially normal relation to the web 114 when the conditioning rod 404 is disposed against the web 114 when experiencing relative motion with regards to the web 114. The conditioning rod 404 may be comprised entirely from a conditioning material or alternatively, the textured surface 410 may be coated, finished or textured to provide the conditioning effect to the web 114. Such coatings may include ceramic, diamond and oxides. In operation, the carrier 304 is actuated in a x-y motion parallel to the plane of the web 114. The conditioning device 400 is actuated to contact the web 114. The relative motion between the conditioning device 400 and the web 114 produces the conditioning effect upon the web 114. The conditioning device 400 may be selectively disposed against the web 114 when the wafer 126 is present in the polishing head 124 to provide "in-situ" conditioning (i.e., conditioning of the web 114 during wafer processing). Alternatively, the conditioning device 400 may be retained in a position spaced from the web 114 during wafer processing and actuated to condition the web 114 periodically between wafer runs. The predetermined motion of the carrier 304 that produces the polishing pattern of the wafer 126 relative the web 114, also provides a conditioning pattern when the conditioning device 400 is disposed against the web 114. If desired, the conditioning pattern may be programmed to be different than the polishing pattern.

Figure 7:
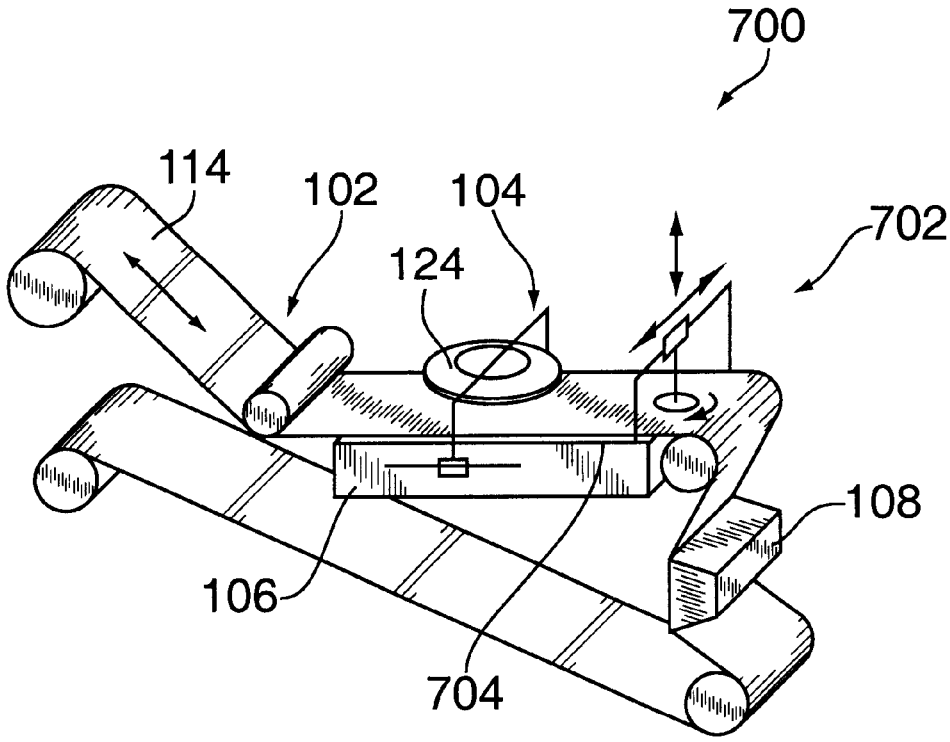
FIG. 7 is a simplified perspective view of another embodiment of a chemical mechanical planarization system having a conditioning device disposed above a polishing media.

FIG. 7 depicts a schematic view of another embodiment of a chemical mechanical planarization system 700. The system 700 comprises a polishing media magazine 102, a linear drive system 104, a base 106, a conditioning device 702 and an optional conditioning module 108. The polishing media magazine 102 and linear drive system 104 are structured and operate as described in the embodiment of FIG. 1. The conditioning device 702 is coupled to a working surface 704 of the base 106 to one side of the linear drive system 104. The conditioning device 702 is shown to the right of the linear drive system 104. However, the conditioning device 702 may alternately be located to the left of the linear drive system 104 or elsewhere in adjacent to the polishing media magazine 102.

Figure 8A:
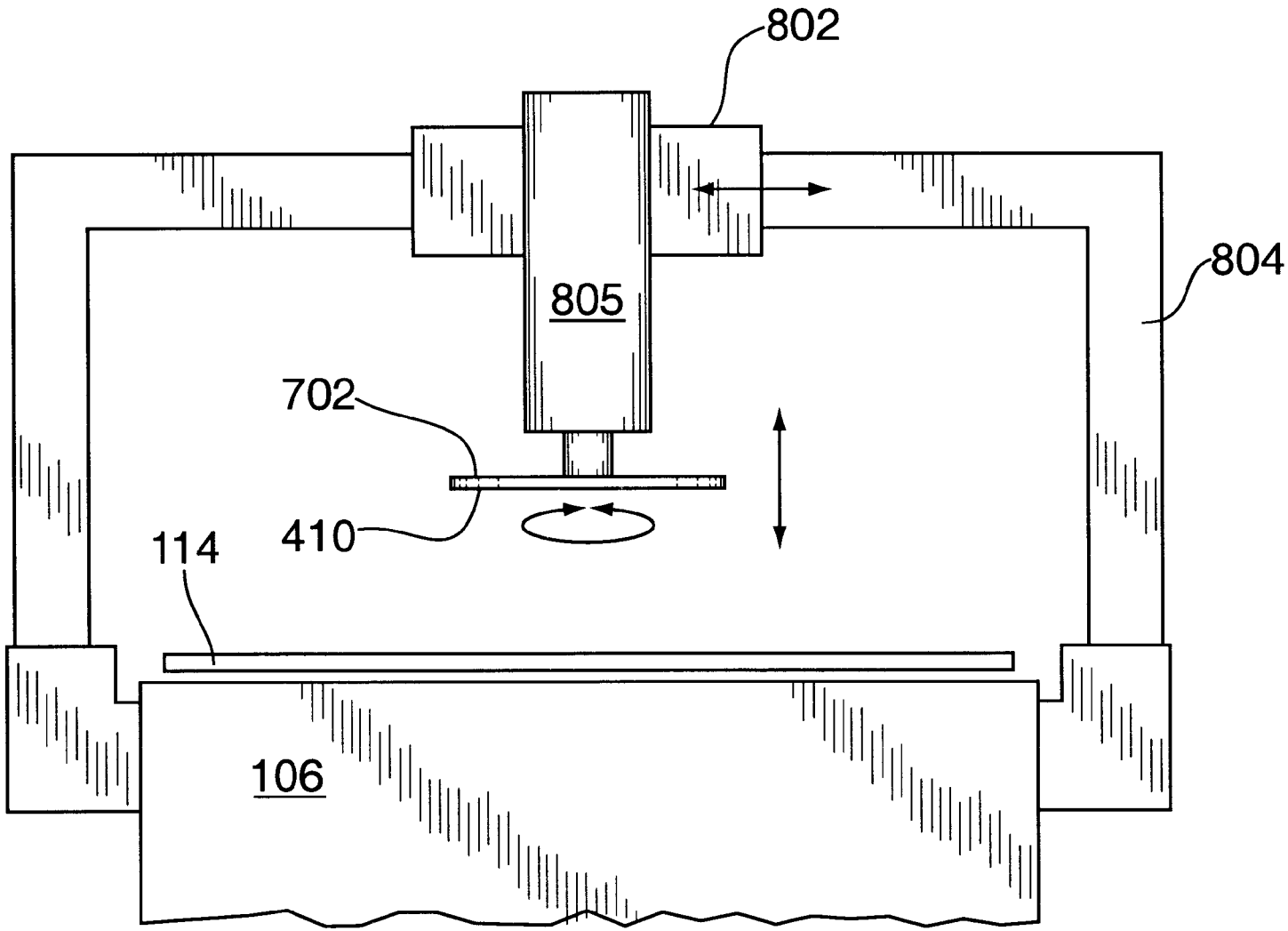
FIG. 8A is a side elevation of one embodiment of the conditioning device of FIG. 7.

Referring to FIG. 8A, the conditioning device 702 is coupled to a linear motion device 802. The linear motion device 802 is coupled to the base 106 by a support 804 such that the web 114 passes between the conditioning device 702 and the base 106. The linear motion device 802 may comprise hydraulic or pneumatic cylinders, ball screws, stepper or servo motors coupled to linear actuators or other linear motion mechanisms.

The conditioning device 702 may be selectively actuated to contact the web 114 when dressing of the web 114 is desired. The conditioning device 702 is generally a rod or disk that is retained to remain in a normal position relative the web 114 when contacting the web 114 and being translated by the linear motion device 802 (and/or having the web 114 move under the conditioning device 702). The conditioning device 702 comprises a textured surface 410 as described with reference to the conditioning rod of FIG. 4. Alternatively, the textured surface may comprise removable conditioning plates as described with reference to the conditioning plates 500 of FIG. 5. Optionally, the conditioning device 702 may be operatively coupled to a motor 805 that rotates the conditioning device 702 about a central axis. Examples of such motors include air or fluid actuators, stepper motors, servo motors or other devices for imparting rotational motion coupled directly or indirectly to the conditioning device 702.

Figure 8B:
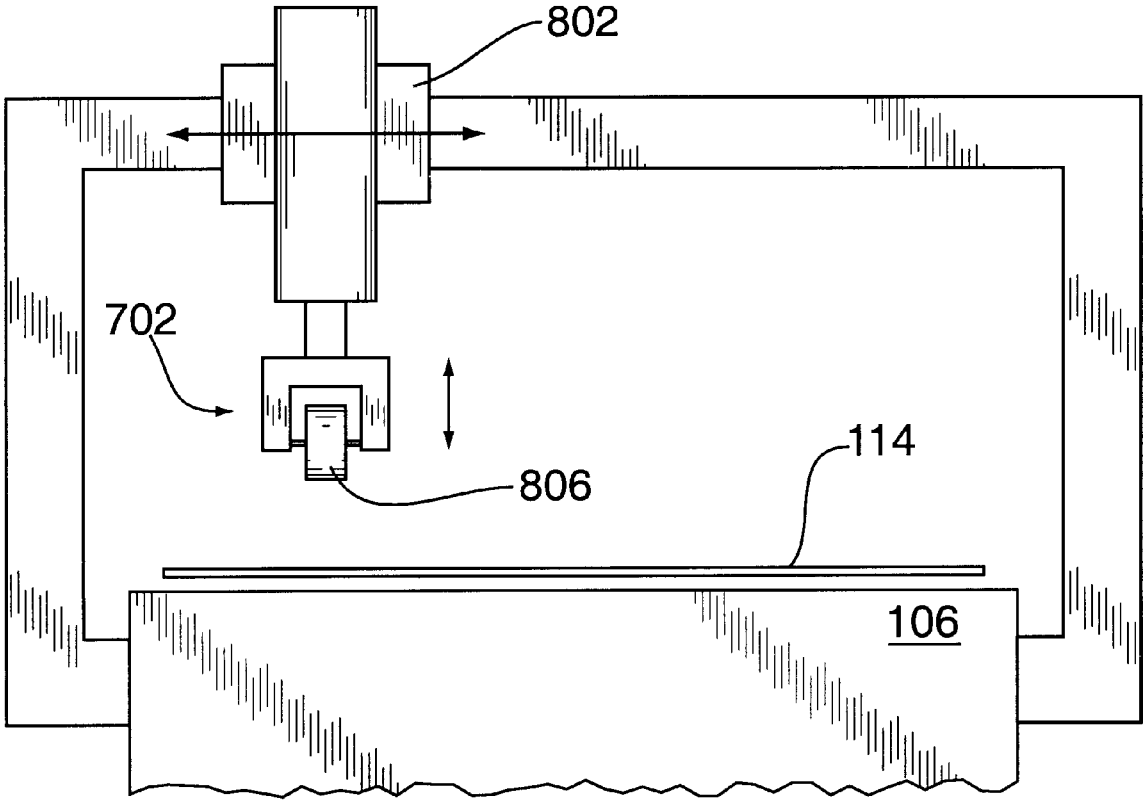
FIG. 8B is a side elevation of another embodiment of the conditioning device of FIG. 7.

Alternatively, the conditioning device 702 may be a rotating cylinder 806 as depicted in FIG. 8B. Generally, the rotating cylinder 806 is coupled to a motor (not shown) that provides the cylinder is a rotary motion substantially parallel to the plane of the polishing media 114. The rotating cylinder 806 is generally similar to the first conditioning roller 202 described with reference to FIG. 2 wherein rotating cylinder 806 is of shorter length and relies upon the linear motion device 802 to dynamically position the rotating cylinder 806 to condition a selected (or entire) width of the web 114.

Returning to FIG. 7, in operation, the web 114 is conditioned by actuating the conditioning device 702 to contact the web 114. The conditioning device 702 is "scanned" across the web 114 by traversing the conditioning device 702 orthogonally to the direction of travel of the web 114 while advancing the web 114 back and forth under the conditioning device 702. Optionally, the conditioning device 702 is rotated while in contact with the web 114.

Figure 9:
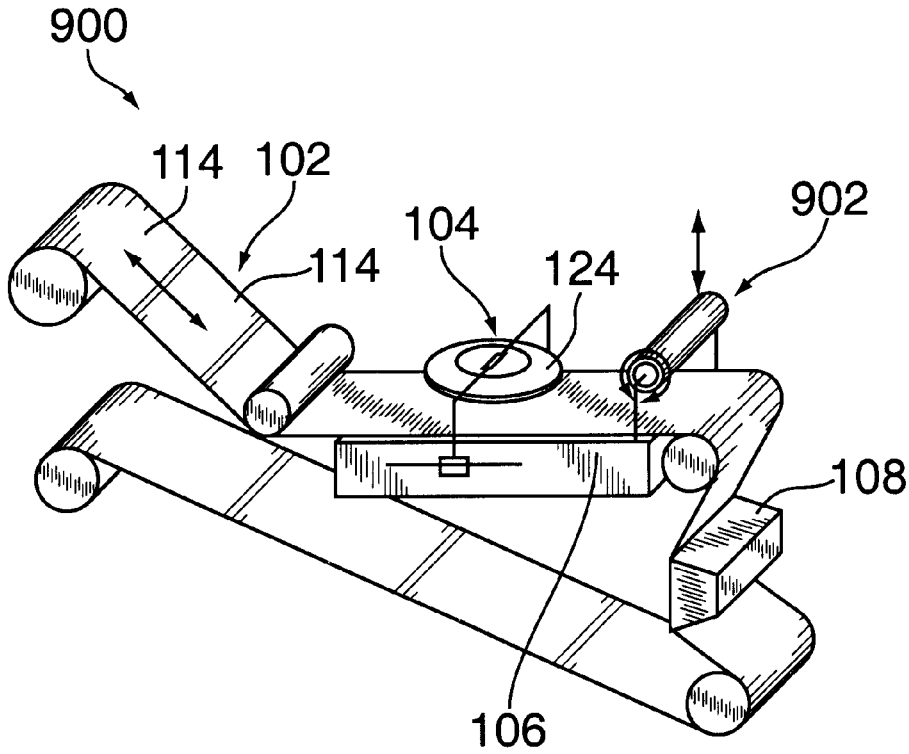
FIG. 9 is a simplified perspective view of another embodiment of a chemical mechanical planarization system having a conditioning device disposed above a polishing media.

FIG. 9 depicts a schematic view of another embodiment of a chemical mechanical planarization system 900. The system 900 comprises a polishing media magazine 102, a linear drive system 102, a base 106, a conditioning device 902 and an optional conditioning module 108. The polishing media magazine 102 and linear drive system 104 are structured and operate as described in the embodiment of FIG. 1. The conditioning device 902 is coupled to a working surface of the base 106 along one side of the linear drive system 104. The conditioning device 902 although pictorially to the right of the linear drive system 104, the conditioning device 902 may alternately be located to the left of the linear drive system 104.

Figure 10:
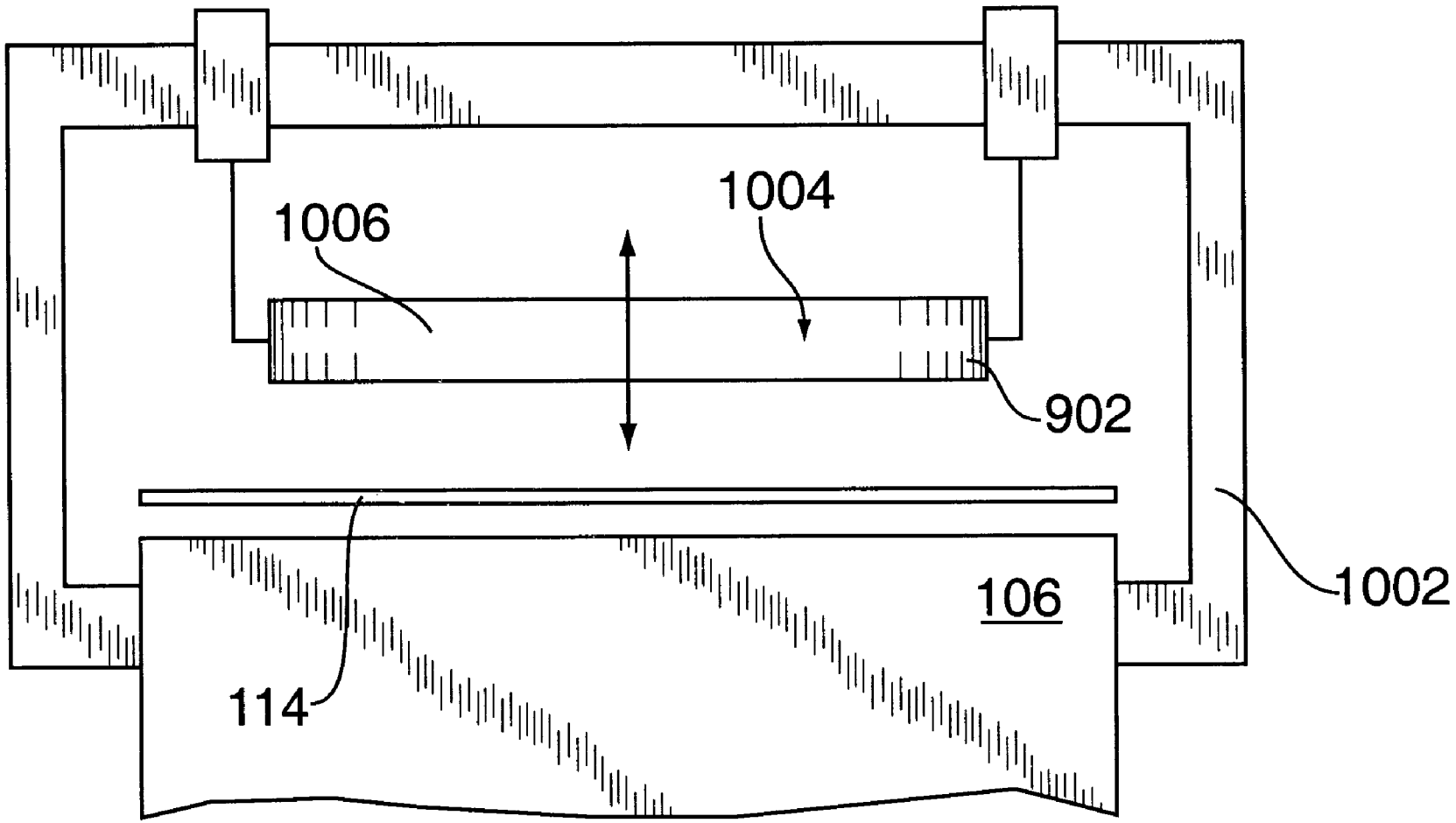
FIG. 10 is a side elevation of the conditioning device of FIG. 9.

Referring to FIG. 10, the conditioning device 902 is coupled to the base 106 by a support frame 1002 such that the web 114 passes between the conditioning device 902 and the base 106. The conditioning device 902 may be selectively actuated to contact the web 114 during dressing of the web 114. The conditioning device 902 is generally a cylinder 1004 having a dressing surface 1006 similar in construction and operation to the first roller 202 depicted with reference to FIG. 2. The dressing surface 1006 is disposed across a length of the cylinder 1004 at least a long as a working surface of the web 114 (i.e., the portion of the web 114 that polishes the substrate) is wide.

Figure 11:
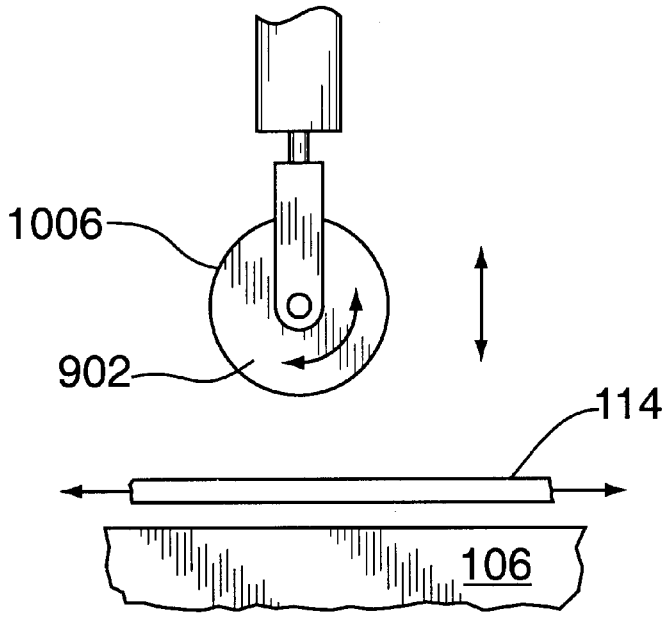
FIG. 11 is a front elevation of the conditioning device of FIG. 10.

Referring to FIGS. 10 and 11, in operation, the web 114 is conditioned by actuating the conditioning device 902 to contact the web 114. The conditioning device 902 is "scanned" relative the web 114 by advancing the web 114 back and forth under the rotating conditioning device 902.

Figure 14:
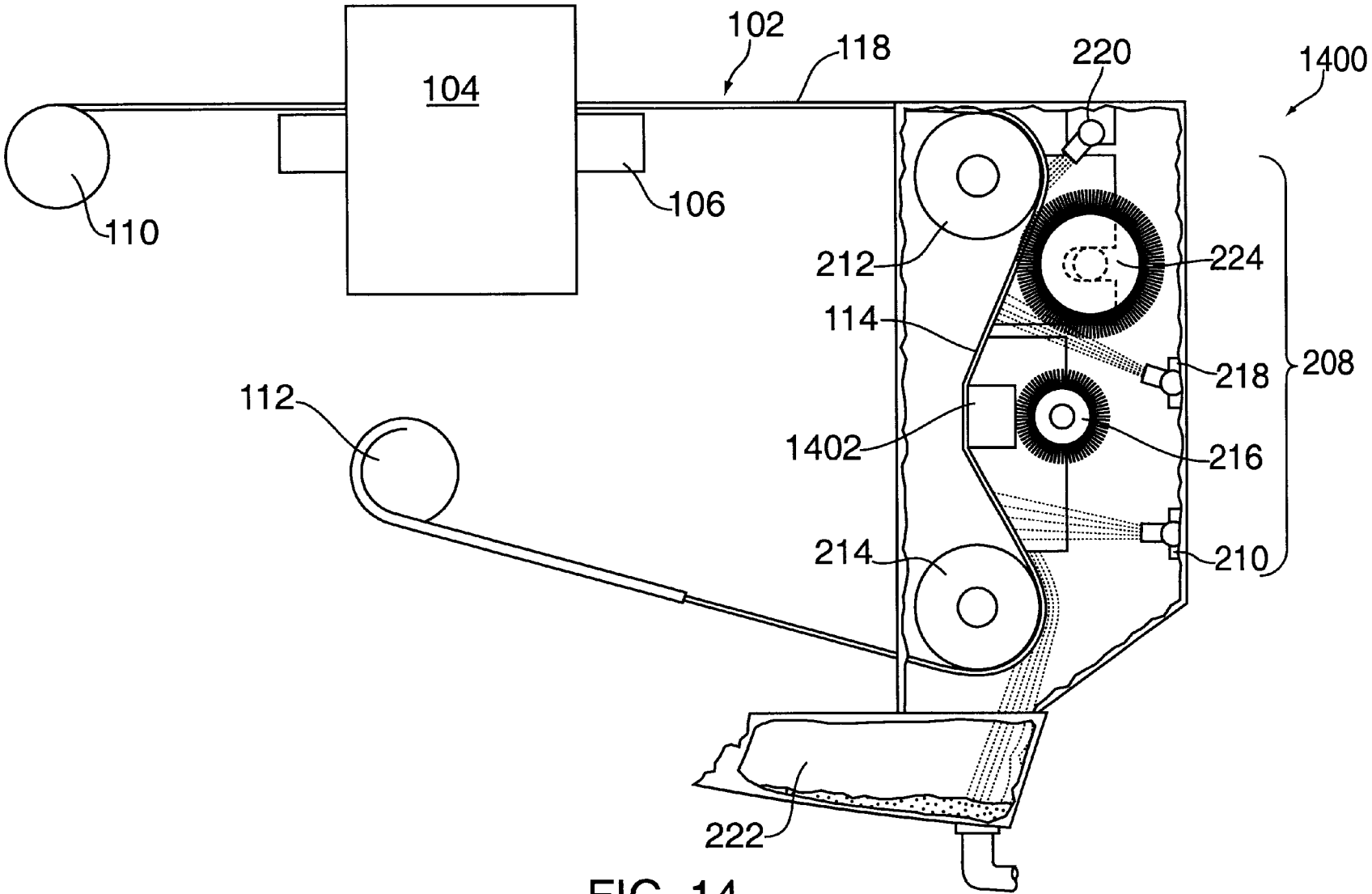
FIG. 14 is a simplified perspective view of alternative embodiments of the chemical mechanical planarization system depicted in FIGS. 8A, 8B, and 10.

FIG. 14 generically depicts alternative embodiments of the embodiment described with reference to FIGS. 8A, 8B and 10. A planarization system 1400 comprises a polishing media magazine 102, a linear drive system 104, a base 106, a conditioning device 1402. The polishing media magazine 102 and the linear drive system are structured and operate as described in the embodiment of FIG. 1.

The conditioning device 1402 is positioned is generally disposed adjacent the web 114 between the base 106 and a winder 112. The conditioning device 1402 may comprise a conditioning device 702 as depicted with reference to FIGS. 8A and 8B, a conditioning device 902 as depicted with reference to 10, or any combination of conditioning modules/devices as disclosed herein. Additionally, the conditioning device may be augmented with additional conditioning devices 208 and waste collector 222 as shown and described with reference to FIG. 2.

Figure 15:
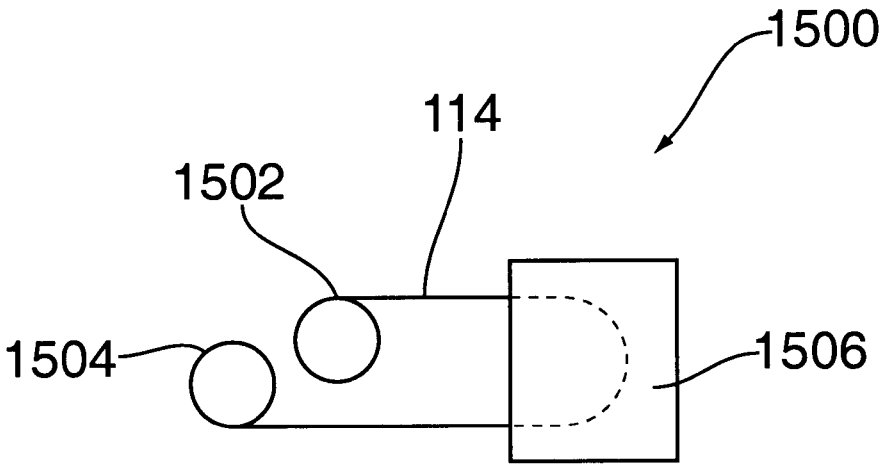
FIG. 15 is a simplified perspective view of a polishing media conditioning system.

FIG. 15 depicts another embodiment of the invention comprising a polishing web conditioning system 1500. The system 1500 comprises an unwind 1502, a conditioning module 1506 and a winder 1504. The unwind 1502, the conditioning module 1506 and the winder 1504 may be coupled together or alternatively be free-standing. A web 114 of polishing media is run from the unwind 1502 to the winder 1504 such that the web may be selectively transferred from the unwind 1502 to the winder 1504. The conditioning module 1506 is disposed adjacent to the web. The conditioning module 1506 may be actuated to contact the web 114 to condition or dress a working surface 118 of the web 114. The conditioning module 1506 may comprise a conditioning module 108 as depicted with reference to FIG. 2, a conditioning device 702 as depicted with reference to FIGS. 8A and 8B, a conditioning device 802 as depicted with reference to 10, or any combination of conditioning modules/devices as disclosed herein.

It should be noted that although some of the embodiments described above illustrate a linear movement of a polishing device in relation to the polishing media, the some devices may be moved in a non-linear motions and impart the desired conditioning effect upon the working surface of the web or polishing media. For example, one skilled in the art may readily devise a non-linear path for the conditioning device depicted in FIGS. 8A and 8B. The movement of the web under the conditioning device may compensate for the portion of the motion not orthogonal to the web, or alternatively, the conditioning pattern may be configured to dress the selected portion of the web with a uniform velocity of the conditioning device relative the web.

Although the teachings of the present invention that have been shown and described in detail herein, those skilled in the art can readily devise other varied embodiments that still incorporate the teachings and do not depart from the spirit of the invention.

What is claimed is:

1. An apparatus for conditioning a polishing surface comprising:

a polishing media;

a carrier;

a polishing head coupled to the carrier, the polishing head disposed proximate the polishing media;

a conditioning device coupled to the carrier; the conditioning device comprising a rod disposed adjacent to the polishing head; the rod having a conditioning surface that selectively contacts the polishing media.

2. The apparatus of claim 1 further comprising:

an actuator coupled to the rod.

3. The apparatus of claim 1 further comprising:

a driver supporting the carrier.

4. The apparatus of claim 1 wherein the rod is in contact with the polishing media as the driver moves the polishing head.

5. The apparatus of claim 1, wherein the conditioning surface is selected from one or more materials consisting of diamond coating, quartz, aluminum oxide, oxides, silicon carbide, cubic boron nitride, ceramic, copper, silicon carbide, resist or plastic.

6. An apparatus for conditioning a polishing surface comprising:

a polishing media; and a first conditioning device having a first rotational axis oriented parallel to the polishing media and a second conditioning device having a second rotational axis oriented parallel to the polishing media, the first and the second conditioning devices disposed proximate the polishing media, wherein the first conditioning device is selectively actuated to contact the polishing media with a first rotational velocity and the second conditioning device is selectively actuated to contact the polishing media with a second rotational velocity in a direction opposing the first rotational velocity.

7. The apparatus of claim 6, wherein the first conditioning device and the second conditioning device each further comprise a textured surface.

8. The apparatus of claim 7, wherein the conditioning surface is selected from one or more materials consisting of diamond coating, quartz, aluminum oxide, oxides, silicon carbide, cubic boron nitride, ceramic, copper, silicon carbide, resist or plastic.

9. The apparatus of claim 7, wherein the first conditioning device further comprises:

a plurality of plates.

10. The apparatus of claim 9, wherein each of the plates further comprise:

a textured surface.

11. The apparatus of claim 9, wherein the plates are releasably attached to the retaining ring.

12. The apparatus of claim 7 further comprising:

a waste collection system.

13. The apparatus of claim 7 further comprising:

one or more additional conditioning devices selectively disposed against the polishing media selected from the group consisting of a brush, a fluid jet and a megasonic wave generator.

14. The apparatus of claim 6 further comprising:

a winder; and an unwind, the polishing media advanced between the winder and the unwind during conditioning.

15. An apparatus for conditioning a polishing surface comprising:

a web of polishing media;

a polishing head disposed proximate the web;

a first drive system supporting the polishing head;

a second drive system disposed proximate the first drive system; and a first conditioning device coupled to the second drive system, wherein the first conditioning device is a disk or rod having textured surface that selectively contacts the polishing media.

16. The apparatus of claim 15, wherein the first conditioning device is selectively actuated to contact the polishing media.

17. The apparatus of claim 15, wherein the first conditioning device is rotated on an axis perpendicular to the polishing media.

18. The apparatus of claim 15, wherein the first conditioning device further comprises:

a cylinder that is selectively disposed against the polishing media.

19. The apparatus of claim 15, wherein the polishing media is advanced when in contact with the first conditioning device.

20. The apparatus of claim 15, wherein the first conditioning device moves relative to the width of the polishing media.

21. The apparatus of claim 15, wherein the first condition device further comprises:

a roller having an centerline disposed parallel to the plane of the polishing media.

22. The apparatus of claim 21, wherein the roller is rotated on its centerline.

23. The apparatus of claim 21, wherein the roller further comprises:

a length at least equal to a width of a working surface the polishing media.

24. The apparatus of claim 21, wherein the web is advanced when in contact with the polishing media.

25. The apparatus of claim 21, wherein the roller further comprises:

a plurality of plates.

26. The apparatus of claim 25, wherein each of the plates further comprise:

a textured surface.

27. The apparatus of claim 25, wherein the plates are releasably attached to the roller.

28. A method for conditioning a web of polishing material comprising the steps of:

advancing a web of polishing material;

moving a conditioner at an angle to the direction of web advancement; and conditioning the polishing material by bringing a first rotating member in contact with the polishing material and bringing a second rotating member having a rotation opposite said first rotating member in contact with the polishing material.

29. The method of claim 28, wherein the advancing step further comprises the step of transferring the web between an unwind and a winder.

30. The method of claim 28, wherein the rotating member rotates on an axis parallel to the polishing material.

31. The method of claim 28, wherein the rotating member rotates on an axis perpendicular to the polishing material.

32. The method of claim 28 further comprising the steps of:

transferring the conditioned web to a processing system;

polishing a substrate on the web; and reconditioning the web on the processing system.

33. A method for conditioning a web of polishing material comprising the steps of:

advancing a web of polishing material;

moving a conditioner at an angle to the direction of web advancement; and conditioning the polishing material by bringing a first rotating member in contact with the polishing material wherein the rotating member rotates on an axis perpendicular to the polishing material.

34. A method for conditioning a web of polishing material comprising the steps of:

advancing a web of polishing material;

moving a conditioner at an angle to the direction of web advancement; and conditioning the polishing material by bringing a first rotating member in contact with the polishing material wherein the rotating member rotates on an axis parallel to the polishing material.

* * * * *

UNITED STATES PATENT AND TRADEMARK OFFICE

CERTIFICATE OF CORRECTION

PATENT NO. : 6,447,374 B1
DATED : September 10, 2002
INVENTOR(S) : Phillip R. Sommer et al.

It is certified that error appears in the above-identified patent and that said Letters Patent is hereby corrected as shown below:

Title page,
Item [75], Inventors, please change "Paul B. Butterfield" to -- Paul D. Butterfield --.

Column 1,
Line 51, please change "programable" to -- programmable --.

Column 2,
Line 58, please insert -- a -- between "comprising" and "polishing".

Column 4,
Line 26, please change "orientated" to -- oriented --.

Column 5,
Line 52, please delete "the".
Line 58, please add "for" after "used".

Column 7,
Line 35, please change "position" to -- positioned --.
Line 35, please delete "as".

Column 8,
Line 7, please begin a new paragraph starting with "In operation,".

Column 10,
Line 18, please change "some devices" to -- same devices --.
Line 19, please delete "a".

Signed and Sealed this

Eighteenth Day of February, 2003

JAMES E. ROGAN
*Director of the United States Patent and Trademark Office*